US011725675B2

(12) United States Patent
Gückel et al.

(10) Patent No.: US 11,725,675 B2
(45) Date of Patent: Aug. 15, 2023

(54) FLUID-ACTUATED LINEAR DRIVE

(71) Applicant: Festo SE & Co. KG, Esslingen (DE)

(72) Inventors: Jürgen Gückel, Filderstadt (DE); Simone Kopp, Esslingen (DE); Ulrich Diener, Esslingen (DE); Mattias-Manuel Speckle, Vaihingen (DE); Andreas Trauschweizer, Esslingen (DE); Bernhard Winter, Eichenbach (DE)

(73) Assignee: Festo SE & Co. KG, Esslingen (DE)

( * ) Notice: Subject to any disclaimer, the term of this patent is extended or adjusted under 35 U.S.C. 154(b) by 39 days.

(21) Appl. No.: 17/396,003

(22) Filed: Aug. 6, 2021

(65) Prior Publication Data

US 2022/0049724 A1 Feb. 17, 2022

(30) Foreign Application Priority Data

Aug. 13, 2020 (DE) ..... 102020210289.9

(51) Int. Cl.
*F15B 15/14* (2006.01)

(52) U.S. Cl.
CPC ..... *F15B 15/14* (2013.01)

(58) Field of Classification Search
CPC ..... F15B 15/14; F15B 15/1404; F15B 15/149
See application file for complete search history.

(56) References Cited

U.S. PATENT DOCUMENTS 2,953,118 A * 9/1960 Flick ..... F15B 15/1433 91/462
5,094,143 A * 3/1992 Andersen, Jr. ..... F15B 15/149 285/191
5,884,549 A * 3/1999 Hosono ..... F16C 29/063 92/146
6,557,452 B1 * 5/2003 Morroney ..... F15B 15/2815 91/465
2001/0035090 A1 * 11/2001 Sato ..... F15B 15/1404 91/394

(Continued)

FOREIGN PATENT DOCUMENTS

DE 19720100 A1 2/1998
DE 69129231 T2 10/1998
DE 20022067 U1 3/2001

(Continued)

*Primary Examiner* — Kenneth Bomberg
*Assistant Examiner* — Matthew Wiblin
(74) *Attorney, Agent, or Firm* — Hoffmann & Baron, LLP

(57) ABSTRACT

A fluid actuated linear drive which includes a drive housing and a drive member which is movable relative to the drive housing. The drive force which is necessary for producing the drive movement is provided by a drive fluid which can be fed and discharged through housing channels of the drive housing. The housing channels each with a lateral coupling opening run out at a housing side surface of the drive housing. An L-shaped attachment coupling part which in the position of use is assembled on the drive housing has a coupling limb which is assigned to a housing rear surface and which is provided with two axial coupling openings. The axial coupling openings are in connection with lateral coupling openings via coupling channels. Hence there is the possibility of using the axial coupling openings for the feed and discharge of the drive fluid.

19 Claims, 4 Drawing Sheets

(56) References Cited

U.S. PATENT DOCUMENTS

2002/0047322 A1* 4/2002 Sato ..... H02K 49/10
310/12.01

FOREIGN PATENT DOCUMENTS

| | | | |
|---|---|---|---|
| DE | 10143878 | A1 | 5/2002 |
| EP | 0868965 | A2 | 10/1998 |
| EP | 1574283 | A1 | 9/2005 |
| JP | H10339308 | A | 12/1998 |

* cited by examiner

FLUID-ACTUATED LINEAR DRIVE

BACKGROUND OF THE INVENTION

The invention relates to a fluid-actuated linear drive comprising a drive housing and a drive member which by way of fluid force can be driven relative to the drive housing into a linear drive movement in a housing longitudinal direction, wherein the drive member comprises a drive unit which comprises a drive piston which in the drive housing separates off two drive chambers from one another, said drive chambers being successive in the housing longitudinal direction and each being connected to one of two housing channels which each with an individual lateral coupling opening run out at a housing side surface of the drive housing which is orientated transversely to the housing longitudinal direction, and can be used for the feed and discharge of a drive fluid which generates the linear drive movement.

A linear drive of this type which is known from EP 1 574 283 B1 has an elongate drive housing and a drive member which is displaceable relative to the drive housing, wherein the drive member comprises a slide body, with which it is guided in a linearly displaceable manner on an outer side of the drive housing. The drive force for generating a linear drive movement of the drive member can be produced by a drive fluid, to which in a manner coordinated with one another two drive chambers of the drive housing can be subjected, said chambers being separated from one another in a fluid tight manner by way of the drive piston of a drive unit of the drive member. Each of the two drive chambers communicates with one of two housing channels which pass through the drive housing and which each with a lateral coupling opening at the outside run out at a housing side surface of the drive housing. Fluid tubes which are suitable for the feed and discharge of the drive fluid are coupled onto the lateral coupling openings.

A linear drive with lateral coupling openings which are arranged on a housing side surface of a drive housing is also described in DE 197 20 100 C2. JP-H10-339308 A also discloses such a fluid-actuated linear drive.

In most application cases, coupling openings which are arranged laterally on the drive housing of a fluid-actuated linear drive are very well suited for the coupling of fluid conduits. However, from time to time there are certain local circumstances, in which it would be more favourable for the user if he could have the possibility of coupling the fluid conduits to a housing rear surface of the drive housing which is orientated at right angles to the housing side surface. For these cases, EP 0 868 965 A2 discloses a fluid-actuated linear drive, concerning which housing channels which communicate with two drive chambers run out via axial connection openings at a housing rear surface of the drive housing which faces the housing longitudinal direction. However, the provision of two different construction types of fluid-actuated linear drives for different connection possibilities entails a significant effort.

SUMMARY OF THE INVENTION

It is the object of the invention to provide inexpensive measures which provide a user of a fluid-actuated linear drive with variable possibilities for the coupling measures which are necessary for the feed and discharge of the drive fluid.

For achieving this object, with regard to a fluid-actuated linear drive in combination with the initially mentioned features, one envisages the linear drive comprising an L-shaped attachment coupling part which is separate with regard to the drive housing, has a coupling limb and a connection limb which projects transversely therefrom, and in a position of use is built onto the drive housing at the outside in a manner such that the connection limb extends in the housing longitudinal direction along the housing side surface and the coupling limb extends in a housing transverse direction which is orthogonal thereto along a housing rear surface of the drive housing which is aligned transversely to the housing side surface, wherein two separate coupling part channels pass through the attachment coupling part, said coupling part channels on the one hand each with a connection opening running out at an inner limb surface of the connection limb which faces the drive housing, in a manner such that they are each connected to one of the two lateral coupling openings, and on the other hand each with an individual axial coupling opening which can be used for the feed and discharge of a drive fluid which produces the linear drive movement running out at an outer limb surface of the coupling limb which is faces away from the drive housing.

The linear drive according to the invention as standard has two lateral coupling openings which are arranged on a housing side surface of its drive housing which is orientated transversely to the housing longitudinal direction, and which each via an internal housing channel of the drive housing communicate with one of two drive chambers which are separated from one another by the drive piston of a drive unit of the drive member. If local circumstances demand such, the user of the linear drive has the possibility, in a direct manner, of using the two lateral coupling openings for coupling fluid conduits, through which the drive fluid which is necessary for producing a linear drive movement of the drive member can be fed and discharged. Furthermore, the linear drive according to the invention however yet also provides the alternative possibility of carrying out the coupling measures which are necessary for the feed and discharge of the drive fluid, at a rear side of the drive housing in the axial direction which coincides with the housing longitudinal direction. This possibility is given by an attachment coupling part of the linear drive which is present additionally to the drive housing and which in the position of use can be or is built onto the drive housing at the outside in a manner such that coupling openings which are formed in it come to lie in the region of the housing rear surface of the drive housing and there are orientated in the housing longitudinal direction, so that they form axial coupling openings which are easily accessible on the drive housing at the rear side for axial coupling measures. The linear drive also has compact dimensions given an assembled attachment coupling part since the attachment coupling part has an L-shape fashion and is attached such that a first L-limb which is denoted as a connection limb extends along the housing side surface and a second L-limb which is denoted as a coupling limb extends along the housing rear surface of the drive housing. The connection openings of two coupling part channels are situated on an inner limb surface of the connection limb which faces the drive housing, said coupling part channels passing through the attachment coupling part and each being in connection with one of the two lateral coupling openings, in order to create a fluid connection to the two drive chambers. Each coupling part channel furthermore runs out with one of the two already mentioned axial coupling openings at an outer limb surface of the coupling limb which is away from the drive housing. Herewith, a linear drive which is basically designed for lateral fluid couplings can be retrofitted for the rear-side, axial fluid coupling by way of the attachment of the separate attachment coupling part into a linear drive. This retrofitting possibility is not entirely left up to the end use of the linear drive, but can also already be used from the factory on manufacture of the linear drive, by way of linear drives which are to be used for lateral fluid coupling measures being delivered without the attachment coupling part and linear drives which are to be used for axial fluid coupling measures being delivered with the attachment coupling part assembled in the position of use.

Advantageous further developments of the invention are to be derived from the dependent claims.

The L-shaped attachment coupling part has a transition section which is arranged between the coupling limb and the connection limb. In this transition section, the two coupling part channels are expediently arranged above one another at a distance in a housing height direction of the drive housing. The housing height direction runs orthogonally to the housing longitudinal direction and to a housing transverse direction which is orthogonal with respect to this. The housing longitudinal direction is the direction in which the housing rear surface faces and concerning which in particular it is a direction of a normal to the housing rear surface. The housing transverse direction is the direction in which the housing side surface faces and concerning which in particular is a direction of a normal to the housing side surface. On account of the arrangement of the two coupling part channels above one another in the transition section, the linear drive can be realised with very compact longitudinal and transverse dimensions.

Preferably, each coupling part channel has a coupling channel section which is formed in the coupling limb and a connection channel section which is formed in the connection limb. Each coupling channel section is connected to the connection channel section which is assigned to it, expediently via an arcuate or angled transition channel section which extends in the attachment coupling part around a rear corner region of the drive housing which lies in the transition region between the housing rear surface and the housing side surface. Each lateral coupling opening and each axial coupling opening is preferably provided with a fastening interface which can be used in a direct or indirect manner for coupling a fluid conduit. The fastening interface is for example an inner thread. A fluid conduit, for example a pipe conduit can be attached to the fastening interface in a direct manner for the direct coupling. A conduit coupling piece, for example a plug-in screw fitting, to which a fluid conduit can be releasably coupled by way of a plug-in connection can be attached to the fastening interface for the indirect coupling.

The attachment coupling part in its position of use is expediently fastened to the drive housing by way of fastening means, wherein it can be fastening means which are separate with regard to the attachment coupling part or also fastening means which are designed at least partly integrally with the attachment coupling part, for example as insert pipe stub. The fastening means in particular are designed such that the attachment coupling part in its position of use is releasably fixed to the drive housing. This provides the possibility of retrofitting a linear drive which is equipped with the attachment coupling part for axial fluid coupling measures, into a construction type for lateral fluid coupling measures, by way of a simple removal of the attachment coupling part.

The fastening means on the part of the attachment coupling part are preferably assigned exclusively to the connection limb, whereas no fastening means are assigned to the coupling limb. In this manner, the fastening measures can be carried out in a unitary manner from a longitudinal side of the drive housing in an easily accessible manner.

Fastening means which comprise two through-holes which are formed in the connection limb at a distance to one another in the housing longitudinal direction and to which a threaded bore of the fastening means which is formed in the drive housing on the housing side surface is assigned are seen as being particularly favourable. Furthermore, these fastening means comprise two fastening screws which engage on the connection limb and which each pass through one of the through-holes and are screwed into one of the threaded bores, so that the connection limb is clamped to the housing side surface of the drive housing in the housing transverse direction.

Expediently, each of the two fastening screws is assigned to one of the two limb end sections of the connection limb which are opposite one another.

It is further advantageous if each fastening screw and accordingly also the assigned through-hole is arranged in the vicinity of one of the two connection openings of the coupling part channels.

In order to ensure a fluid passage between the attachment coupling part and the drive housing, said passage being sealed to the surroundings, it is advantageous if a sealing ring which frames the assigned connection opening is arranged and in particular clamped between the housing side surface and the inner limb surface of the connection limb in the region of each lateral coupling opening. Herein, the use of an inexpensive O-ring is particularly advantageous.

The connection limb of the attachment coupling part has two limb end sections which are opposite one another in the housing longitudinal direction. Expediently, one of the two connection openings is arranged in each of these two limb end sections. Preferably, a limb web section of the connection limb which in a housing height direction which is orthogonal to the housing longitudinal direction and to the housing transverse direction has a lower height that the two limb end sections extends between the two limb end sections. This shaping in particular originates from the fact that the attachment coupling part has a recess between the two limb end sections, so that the connection limb when considered in the housing transverse direction has a U-shaped structure. This entails a particularly low material consumption for realising the attachment coupling part.

The two axial coupling openings of the coupling limb are expediently arranged next to one another in the housing transverse direction in the region of the rear side of the drive housing. With respect to the housing height direction which is explained further above, the two axial coupling openings expediently lie at the same height.

The attachment coupling part is designed as one piece in a particularly inexpensive construction form. In particular, given a single-piece embodiment, a generative manufacture by way of a so-called 3D printing method is expedient. Hereby, the use of so-called CLIP technology has been found to be particularly expedient, wherein CLIP stands for continuous liquid interface production. In contrast to layer-constructing generative methods which in principle are likewise usable, such as for example the so-called laser sintering, objects without visible layers can be manufactured with CLIP technology. Furthermore, by way of using a fluid starting material, complex coupling part channels can also be integrated without any problem since no powder as is usually used with laser sintering and which is difficult to remove settles therein.

In a preferred alternative design, the attachment coupling part is designed in a multi-part manner. In this case, it has an angled rear coupling part end body which comprises the two axial coupling openings and a rear connection opening of the two connection openings, as well as a front coupling part end body which comprises a front connection opening of the two connection openings. These two coupling part end bodies are manufactured separately from one another, wherein these can preferably be components which are generatively manufactured in the already described manner.

In a possible design, the two coupling part end bodies are inserted into one another in a direct and telescopic manner in the region of the connection limb. The length of the connection limb can be adapted to the construction length of the drive housing and in particular to the mutual distance of the lateral coupling openings of the drive housing by way of the selection of a suitable insertion depth. Given a construction manner which is alternative to this but is likewise advantageous, the two coupling part end bodies are not directly inserted into one another but are connected to one another by pipe body which is arranged therebetween and which with end sections which are opposite one another is inserted into the two coupling part end bodies. This pipe body can be inexpensively cut into the desired length from a pipe material which is sold by the metre, wherein it can be designed as a plastic pipe or also as a metal pipe. For manufacturing linear drives of a different construction length, front and rear coupling part end bodies which are of the same type and which merely need to be combined with simply manufacturable pipe bodies of a different construction length can be inexpensively used.

With regard to a simple and compact design, the drive member only comprises a single drive unit. The drive unit comprises a drive piston and expediently a piston rod which is connected to the drive piston. The piston rod which projects out of the drive housing permits the tapping of the drive movement.

Should high drive forces be able to be produced given compact dimensions, a design of the linear drive with two drive units which are arranged next to one another in the housing transverse direction, is recommended. Herein, one of the two drive units forms a first drive unit which divides two drive chambers from one another, said drive chambers in the manner described further above being each connected to one of the two housing channels which each run out with an individual lateral coupling opening at the housing side surface. The second drive unit likewise separates two drive chambers from one another, said drive chambers being successive in the housing longitudinal direction and for the fluid supply being in fluid connection with one of the drive chambers which are assigned to the first drive unit, each via an individual transverse channel of the drive housing. In this manner, one achieves a synchronous, fluid subjection of the two drive units in the same direction given a controlled feed and discharge of the drive fluid.

The two drive units are expediently fixedly connected to one another outside the drive housing via a yoke part of the drive member, so that a movement unit is present.

The yoke part is preferably a constituent of a slide body of the linear drive which is linearly displaceably mounted on the drive housing at the outside by way of a linear guide device. The slide body has at least one fastening interface, to which an external component, for example a machine component, which is to be moved by way of the linear drive movement, can be fastened. The linear drive can also be provided with a slide body which is guided in a linearly displaceable manner, if the drive member has only a single drive unit.

BRIEF DESCRIPTION OF THE DRAWINGS

The invention is hereinafter described in more detail by way of the attached drawing. In this are shown.

DETAILED DESCRIPTION

Figure 1:
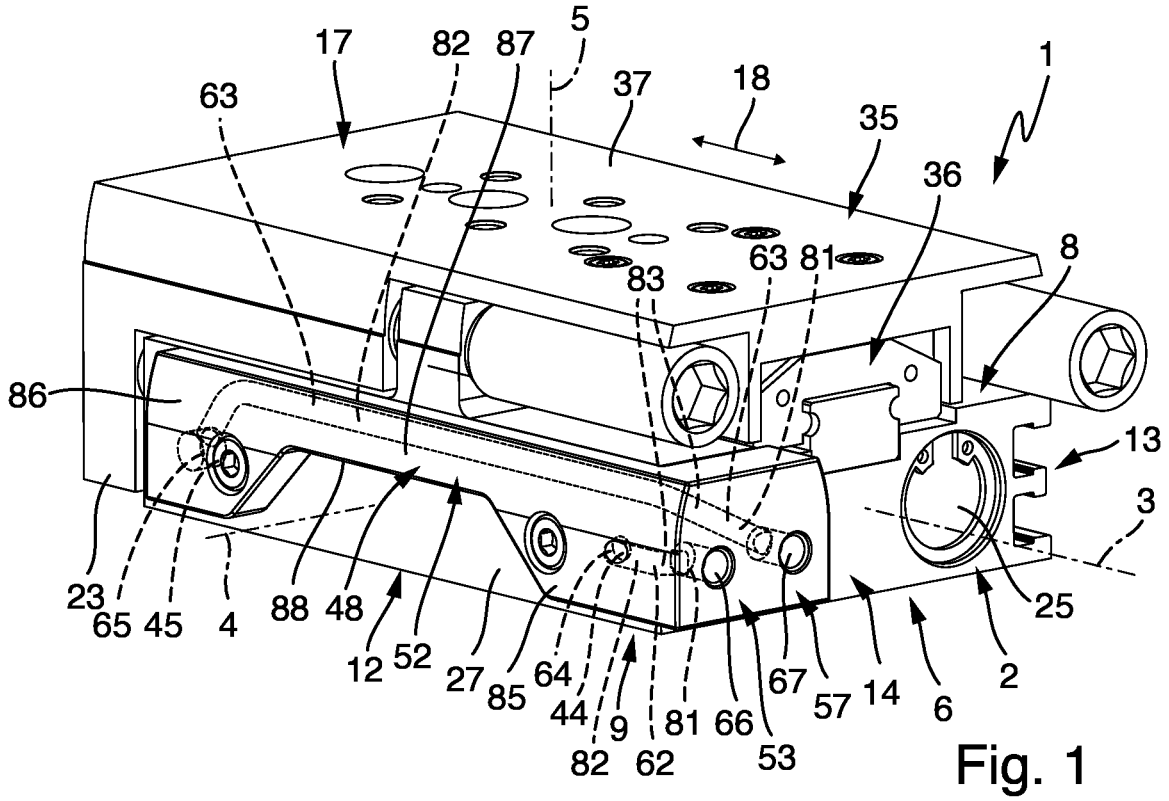
FIG. 1 an isometric rear view of a preferred construction form of the fluid-actuated linear drive according to the invention, with an attachment coupling part which is assembled in the position of use, FIG. 2 an isometric front view of the linear drive of FIG. 1 in the state of the attachment coupling part not yet assembled in the position of use, FIG. 3 a longitudinal section of the linear drive according to the section plane III-III of FIG. 5, wherein a state of the drive housing given a non-assembled attachment coupling part is shown in a detailed representation which is framed in a dot-dashed manner, FIG. 4 a further longitudinal section of the linear drive according to section plane IV-IV of FIG. 5, FIG. 5 a cross section of the linear drive according to section plane V-V of FIGS. 3 and 4, FIG. 6 an isometric individual representation of a multi-part attachment coupling part, FIG. 7 the attachment coupling part of FIG. 6 before the assembly of its components, FIG. 8 a further embodiment of a multi-part attachment coupling part, and FIG. 9 the attachment coupling part of FIG. 8 before the assembly of one of the several components.

The fluid-actuated linear drive which is denoted in its entirety with the reference numeral 1 is preferably designed for actuation by way of pressurised air as a drive fluid, but is also suitable for actuation by way of other gaseous or also liquid drive fluids.

The linear drive 1 comprises a drive housing 2 which preferably has a longitudinal shape and is with a longitudinal axis 3, a transverse axis 4 which is at right angles thereto and a height axis 5 which in turn is at right angles to the two aforementioned axes 3, 4. The axis directions of the aforementioned three axes, whilst using the respective same reference numeral, in the case of the longitudinal axis 3 is denoted as a housing longitudinal direction 3, in the case of the transverse axis 4 as a housing transverse direction 4 and in the case of the height axis 5 as a housing height direction 5.

The drive housing 2 is preferably designed in a plate-like or block-like manner.

The drive housing 2 has a housing rear side 6 which is orientated in the housing longitudinal direction 3 and a housing front side 7 which is axially opposite with respect to this. Furthermore, the drive housing 2 has a housing upper side 8 which is orientated in the housing height direction 5 and a housing lower side 9 which is opposite with respect to this. And finally, the drive housing 2 has two first and second lateral longitudinal sides 12, 13 which are orientated in the housing transverse direction 4 and are opposite one another.

The drive housing 2 has a housing rear surface 14 in the region of the housing rear side 6. The housing rear surface 14 faces in the housing longitudinal direction 3, wherein the housing longitudinal direction 3 preferably represents a direction of a normal to the housing rear surface 14. At the housing front side 7, the drive housing 2 has a housing front surface 15 which is preferably directed equally to the housing rear surface 14.

The drive housing 2 further has a housing side surface 16 which extends all around the drive housing 2 between the housing rear surface 14 and the housing front surface 15. Accordingly, the housing side surface 16 is composed of several side surface sections which merge into one another, wherein a first side surface section 16*a* is formed on the first lateral longitudinal side 12, a second side surface section 16*b* on the housing lower side 9, a third side surface section 16*c* on the second lateral side 13 and a fourth side surface section 16*d* on the housing upper side 8.

The drive housing 2 in a cross section at right angles to the longitudinal housing 3 preferably has an at least essentially rectangular outer contour.

The linear drive 1 further comprises a drive member 17 which can be displaced linearly to and fro in the housing longitudinal direction 3 with respect to the drive housing 2. The drive member 17 is driveable by the drive fluid into a linear drive movement 18 in the housing longitudinal direction 3, said drive movement being indicated by the double arrow. The drive movement 18 in particular can be designed as a to and fro linear movement.

The drive member 17 has two drive units 21 which hereinafter for the improved differentiation are also denoted as the first drive unit 21*a* and the second drive unit 21*b*. The two drive units 21 lie in a common drive plane which is at right angles to the height axis 5. They are distanced to one another in the housing transverse direction 4, wherein the first drive unit 21*a* is adjacent to the first lateral longitudinal side 12 and the second drive unit 21*b* to the second lateral longitudinal side 13.

The drive units 21 partly extend within and partly outside the drive housing 2. By way of example, they each project out of the drive housing 2 at the housing front surface 15. They are fixedly connected to one another outside the drive housing 2, so that they can only be moved as one unit. For the connection, by way of example a yoke part 23 of the drive member 17 which is arranged axially in front of the housing front surface 15 is provided.

Each drive unit 21 extends in an individual housing chamber 24 which is formed in the inside of the drive housing 2 and which is preferably contoured in a cylindrical manner Hereinafter, the housing chamber 24 which is assigned to the first drive unit 21*a* is also denoted as the first housing chamber 24 and the housing chamber 24 which is assigned to the second drive unit 21*b* is also denoted as the second housing chamber 24*b*.

Each housing chamber 24 in the region of the housing rear side 6 is closed in a fluid tight manner by a rear closure cover 25 and in the region of the housing front side 7 by a front closure cover 26 of the drive housing 2.

Preferably, the drive housing 2 has a rigid housing base body 27, on which the housing rear surface 14, the housing front surface 15 and the housing side surface 16 are formed in a direct manner and into which the closure covers 25, 26 are inserted from the housing rear side 6 and from the housing front side 7 whilst delimiting the two housing chambers 24. The closure covers 25, 26 can alternatively also be applied onto the housing base body 27 at the outside.

Each drive unit 21, 21*a*, 21*b* has a drive piston 28 which is arranged in the assigned housing chamber 24, 24*a*, 24*b*. The drive piston 28 bears on the wall of the assigned housing chamber 24 in a slidingly displaceable manner amid sealing and subdivides the assigned housing chamber 24, 24*a*, 24*b* into a rear drive chamber 32 which faces the housing rear surface 14 and a front drive chamber 33 which faces the housing front surface 15. Each rear drive chamber 32 is closed at its rear side by one of the rear closure covers 25, whereas each front drive chamber 33 is closed at its front side by one of the front closure covers 26.

Each drive unit 21 preferably has a piston rod 29 which is attached to the assigned drive piston 28 and which extends through the respectively assigned front drive chamber 33 and—in a sealed and slidingly displaceable manner—extends through the front closure cover 26 connecting thereto and which as an outer end section 34 which is opposite to the drive piston 28 and with which it is fastened to the yoke part 23. In this manner, the two drive units 21 are linearly movable always only synchronously.

The yoke part 23 is expediently a constituent of a slide body 35 of the drive member 17 which is linearly displaceably mounted on the drive housing 2 at the outside by way of a linear guide device 36 which extends in the housing longitudinal direction 3. The linear guide device 36 is expediently arranged on the housing upper side 8. The slide body 35 preferably has an L-shaped fashion with two L-limbs, of which the one is formed by the yoke part 23 and the other by a plate-like slide body section 37 which extends beyond the housing upper side 8 in a plane which is at right angles to the height axis 5, and interacts with a linear guide device 36.

Preferably, at least one fastening interface 38 is formed on the slide body 37, to which fastening interface an external component, for example a machine part which is to be moved by way of the linear drive 1 can be fastened.

With regard to an embodiment example which is not illustrated, the slide body 37 is done away with and only one yoke part 23 is present for the movement coupling of the two drive units 21, 21*a*, 21*b*. In this case, at least one fastening interface 38 is located on the yoke part 23.

With regard to an embodiment example which is likewise not illustrated, the linear drive 1 has only a single drive unit 21 whose design with associated constraints corresponds to that of the first drive unit 21*a* of the illustrated embodiment example. Inasmuch as the subsequent description relates to the first drive unit 21*a* and to the measures which are assigned to this, that which has been said accordingly apply to a linear drive which has only a single drive unit 21.

Each of the two drive chambers 32, 33 which are assigned to the first drive unit 21*a* is in fluid connection with one of two housing channels 42, 43 which passes through the drive housing 2 and in particular is formed in the housing base body 27. For an improved differentiation, the housing channel 42 which is connected to the rear drive chamber 32 is also hereinafter denoted as the rear housing channel 42 and the housing channel 43 which is connected to the front drive chamber 33 is also denoted as a front housing channel 43.

Each of the two housing channels 42, 43 runs out at the housing lateral surface 16 of the drive housing 2 with its own lateral coupling opening 44, 45, wherein the lateral coupling opening 44 which belongs to the rear housing channel 42 is hereinafter also denoted as the rear lateral coupling opening and the lateral coupling opening 45 which belongs to the front housing channel 43 is also denoted as the front lateral coupling opening 45.

Preferably, the lateral coupling openings 44, 45 are located on the first side surface section 16*a*. They are arranged distanced to one another in the housing longitudinal direction 3. Expediently, the rear lateral coupling opening 44 is located adjacently to the housing rear side 6 and the front coupling opening 45 adjacently to the housing front side 7. The two lateral coupling openings 44, 45 in particular lie in a common opening plane 46 which runs at right angles to the height axis 5 and which expediently coincides with the drive plane 22.

The lateral coupling openings 44, 45 can be used in order to subject the respective assigned drive chamber 32, 33 to the drive fluid in a controlled manner so that the linear drive movement 18 is generated.

Figure 3:
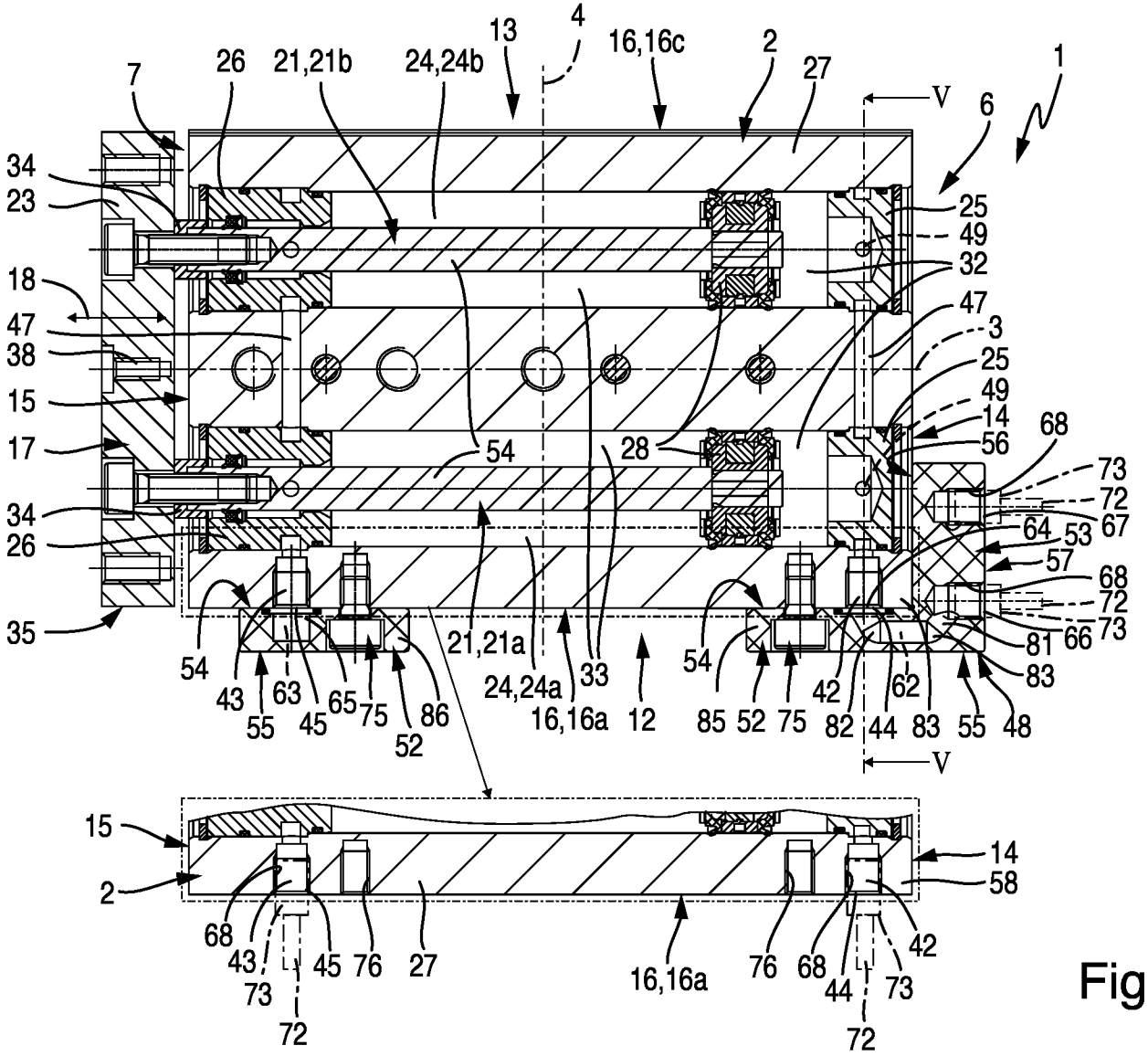

By way of example, concerning the fluidic activation of the drive chambers 32, 33 which are assigned to the first drive unit 21, 21*a*, a simultaneous, synchronous fluid activation of the drive chambers 32, 33 which are assigned to the second drive unit 21, 21*b* is effected. This is ensured by way of two transverse channels 47 being formed in the drive housing 2 and in particular in its housing base body 27, of which transverse channels the one constantly fluidically connects the two rear drive chambers 32 to one another and the other the two front drive chambers 33 to one another. The transverse channels 47 each preferably communicate with the assigned drive chamber 32, 33 through one of the closure covers 25, 26. A corresponding connection channel section is evident in FIGS. 3 and 5 at 49, wherein it lies above the plane of the drawing in FIG. 3.

The transverse channels 47 are done away with if the linear drive 1 as a single drive unit 21 only comprises the first drive unit 21*a*.

Figure 2:
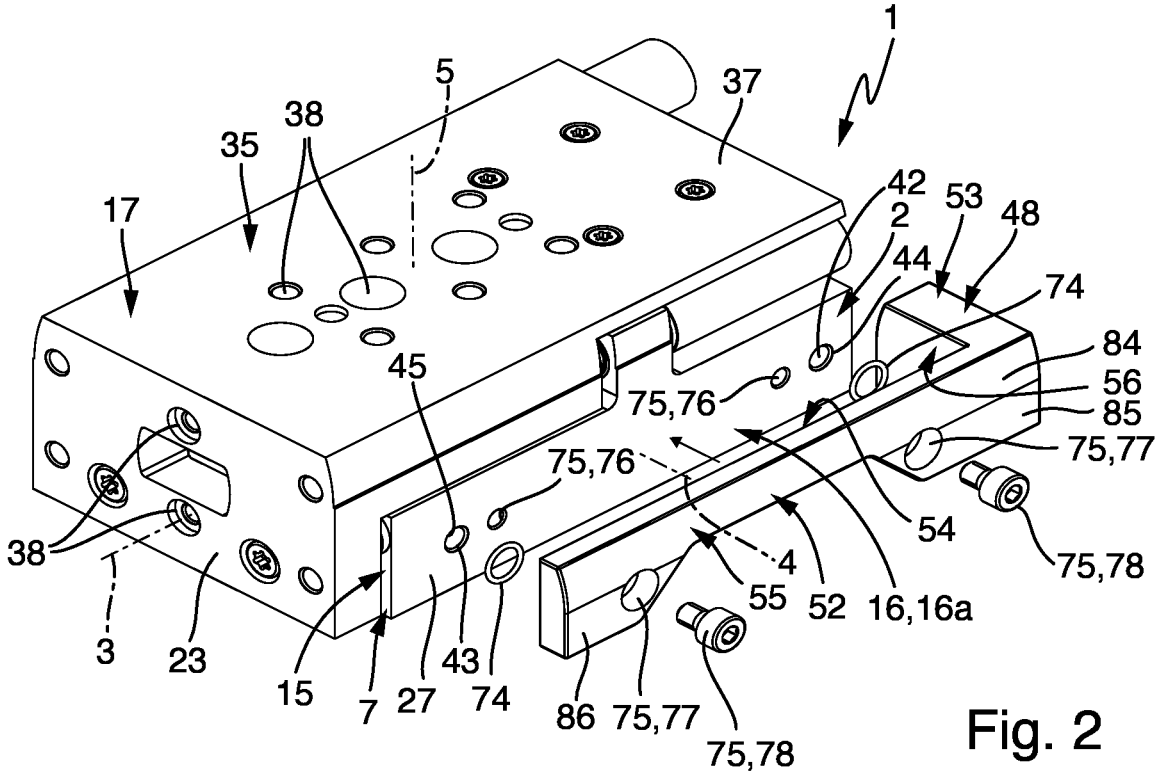
Figure 4:
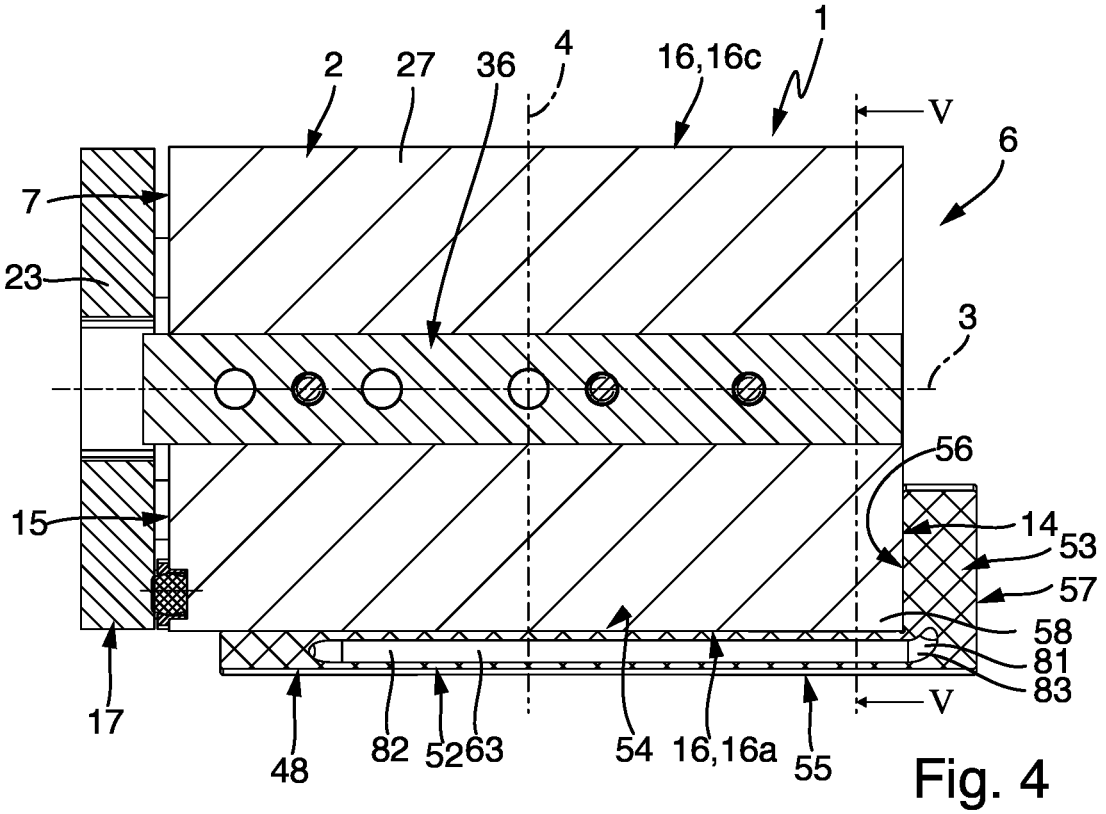
Figure 5:
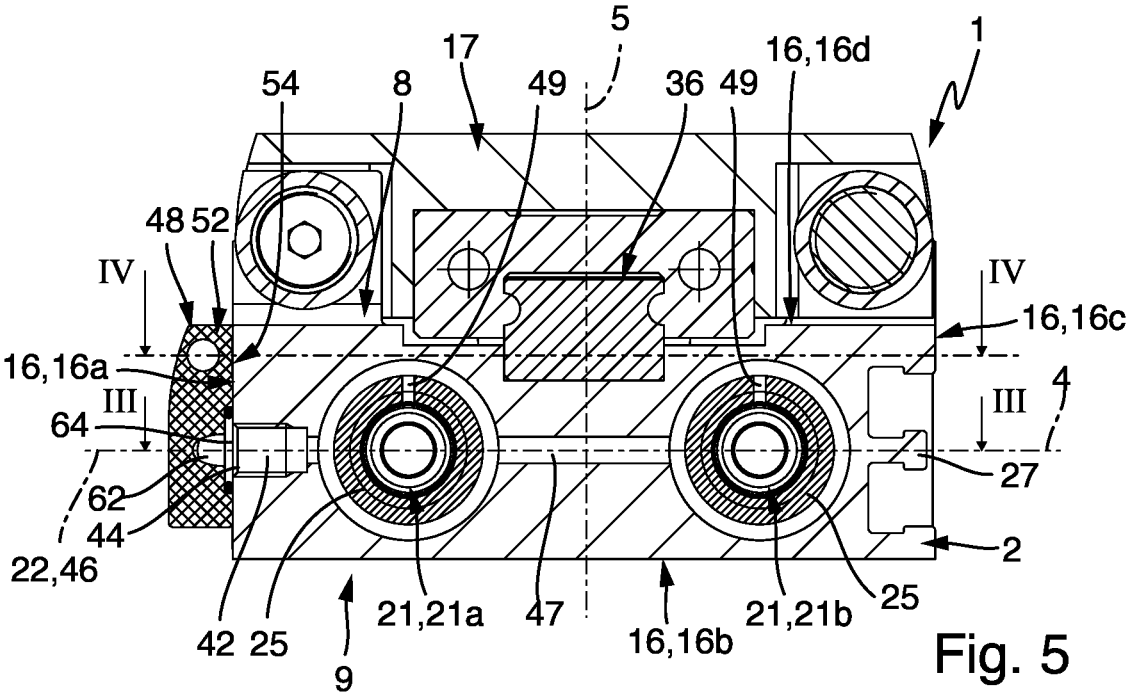

The linear drive 1 as a further component comprises an attachment coupling part 48 which is separate with respect to the drive housing 2 and also with respect to the drive member 17. The attachment coupling part 48 can assume a position of use which is shown in FIGS. 1, 4 and 5 as well as in the upper picture part of FIG. 3, in which position of use it is constructed onto the drive housing 2 and is fastened to the drive housing 2. Alternatively, the attachment coupling part 48 can also assume a stand-by position which is illustrated in FIG. 2 and in which it is not built onto the drive housing 2 and is consequently separated from the drive housing 2. The further details, inasmuch as is not stated otherwise, relate to the position of use of the attachment coupling part 48, in which it is assembled on the drive housing 2.

As is particularly well evident from FIGS. 1, 4, 6 and 8, the attachment coupling part 48 preferably has an L-shaped fashion. It has two first and second L-limbs 52, 53 which are aligned at an angle and in particular at right angles to one another and which are hereinafter also denoted as connection limbs 52 and as coupling limbs 53.

In the position of use of the attachment coupling part 48, the coupling limb 53 lies opposite the housing rear surface 14 in the housing longitudinal direction 3, whereas the connection limb 52 lies opposite the housing side surface 16 and herein in particular its first side surface section 16*a* in the housing transverse direction 4. The connection limb 52 extends in the housing longitudinal direction 3 along the first side surface sections 16*a* of the housing side surface 16 whereas the coupling limb 53 extends in the housing transverse direction 4 along the housing rear surface 14.

The connection limb 52 has an inner limb surface 54 which faces the drive housing 2 and with which it bears on a first side surface section 16*a* of the housing side surface 16 in the position of use of the attachment coupling part 48. The coupling limb 53 for its part has an inner limb surface 56 which faces the housing rear surface 14 and in the position of use of the attachment coupling part 48 expediently bears on the housing rear surface 14.

The drive housing 2 has a rear corner region 58 which lies between the first side surface section 16*a* and the housing rear surface 14. The assembled attachment coupling part 48 extends around this rear corner region 58.

Two first and second coupling part channels 62, 63 which are formed separately from one another, pass through the attachment coupling part 48. Each coupling part channel 62, 63 connects one of two connection openings 64, 65 which are arranged on the inner limb surface 54 of the connection limb 52, to one of two axial coupling openings 66, 67 which are formed on an outer limb surface 57 of the coupling limb 53 which is away from the inner limb surface 56.

Whereas therefore the lateral coupling openings 44, 45 which are formed on the drive housing 2 are orientated in the housing transverse direction 4, the axial coupling openings 66, 67 which are formed on the attachment coupling part 48 are orientated in the housing longitudinal direction 3 and thus axially.

Of the two connection openings 64, 65, a rear connection opening 64 of the two connection openings 64, 65 is placed such that in the position of use of the attachment coupling part 48 it is flush with the rear lateral coupling opening 44, by which means the assigned first coupling part channel 62 is in fluid connection with the rear drive chamber 32. Furthermore, a front connection opening 65 of the two connection openings 64, 65 is placed on the connection limb 62 such that in the position of use of the attachment coupling part 48 it is flush with the front lateral coupling openings 45, by which means the second coupling part channel 63 is in fluid connection with the front drive chamber 33.

Of the two axial coupling openings 66, 67, a first axial coupling opening 66 belongs to the first coupling part channel 62 and a second axial coupling opening 67 to the second coupling part channel 63.

Given the attachment coupling part 48 in the position of use, the two axial coupling openings 66, 67 can be used for the feed and the discharge of the drive fluid which is necessary for the actuation of the drive member 17. Since these axial coupling openings 66, 67 are arranged in front of the housing rear surface 14 in the housing longitudinal direction 3 and are moreover aligned in the housing longitudinal direction 3, the necessary coupling measures can be carried out comfortably in the axial direction of the drive housing 2 in the region of the housing rear side 6.

Alternatively, the linear drive 1 can also be used in a state of the attachment coupling part 48 being removed into the stand-by position. In this case, coupling measures which are necessary for the feed and discharge of the drive fluid take place at the two lateral coupling openings 44, 45 which are orientated in the housing transverse direction 4. This is illustrated in the lower picture part of FIG. 3.

Expediently, each lateral coupling openings 44, 45 and each axial coupling opening 66, 67 are provided with a fastening interface 68 which is designed in order to be able to directly or indirectly couple a fluid conduit 72 which can be used for the feed and/or discharge of the drive fluid and which is only indicated schematically in the drawing. By way of example, the fastening interfaces 68 are designed as an inner thread. A correspondingly designed fluid conduit 72 if required can be screwed directly into the respective fastening interface 68. For an indirect fastening which is illustrated in the drawing, a conduit coupling piece 73 which is only indicated in a dot-dashed manner and on which for its part a fluid conduit 72 is can be releasably fixed can be fastened to the desired fastening interface 68. The conduit coupling pieces 73 in particular are designed for a releasable plug-in connection of a fluid conduit 72.

Given an assembled attachment coupling part 48, a sealing ring 74 which frames the pairs of lateral coupling openings 44, 45 and connection openings 64, 65 which are flush with one another and which is clamped between the inner limb surface 54 of the connection limb 52 and the first side surface section 16*a* of the drive housing 2 is expediently provided in the region of each lateral coupling opening 44, 45. Instead of being designed as separate sealing rings 74, the sealing rings 74 can also be designed as a suitable sealing contour on the connection limb 52.

For the fixation of the position of use of the attachment coupling part 48, the linear drive 1 expediently comprises suitable fastening means 75. These fastening means 75 are expediently designed for a releasable fixation of the attachment coupling part 48 which is the case with the illustrated embodiment example. Thus the user of the linear drive 1 at all times has the possibility of selectively bringing the attachment coupling part 48 into the position of use or into the stand-by position. Of course, there is also the alternative possibility of designing the fastening means 75 for a non-releasable fixation of the position of use of the attachment coupling part 48, for example by way of a realisation as a fixedly latching latch connection means.

The fastening means 75 are expediently exclusively assigned to the connection limb 52 which are arranged on the housing side surface 16. This is the case with the illustrated embodiment example. The fastening measures can therefore be carried out in a comfortable manner exclusively in the region of the first side surface section 16*a*, which simplifies the handling.

The fastening means 75 comprise by way of example two blind-hole-like threaded bores 76 which are formed in the drive housing 2, are open to the first side surface section 16*a*, are distanced to one another in the housing longitudinal direction 3 and expediently likewise lie in the plane of the opening 46. Furthermore, the fastening means 75 comprise two through-holes 77 which pass through the connection limb 52 in the housing transverse direction and whose distance to one another corresponds to the mutual distance of the two threaded bores 76 and are placed such that they are each flush with one of the threaded bores 76 when the attachment coupling part 48 is attached onto the drive housing 2 for assuming the position of use. Finally, the fastening means 75 yet also comprise two fastening screws 78 which from the outer limb surface 55 of the connection limb 52 which is away from the inner limb surface 54 is inserted through one of the through-holes 77 and is screwed into the assigned threaded bore 76. Herein, each fastening screw 78 with a screw head is supported on the outer limb surface 55 which is away from the drive housing 2, and tightens the connection limb 52 to the first side surface section 16*a* of the housing side surface 16 in the housing transverse direction 4. The screw head is expediently sunk in the connection limb 52.

Each coupling part channel 62, 63 expediently has a coupling channel section 81 which comes from one of the two axial coupling openings 66, 67 and is formed in the coupling limb 53. Furthermore, each coupling part channel 62, 63 has a connection channel section 82 which comes from one of the lateral coupling openings 44, 45 and is formed in the connection limb 52. Furthermore, expediently each coupling part channel 62, 63 has an arcuate or angular transition channel section 83 which connects the coupling channel section 81 to the connection channel section 82. The transition channel sections 83 are assigned to the rear corner region 58 of the drive housing 2 and extend within the attachment coupling part 48 around this rear corner region 58.

The transition channel sections 83 are formed in a transition section 84 of the attachment coupling part 48 which is arranged between the coupling limb 53 and the connection limb 52. In the transition section 84, the two coupling part channels 62, 63 are arranged distanced to one another in the housing height direction 5.

The connection limb 52 has a rear limb end section 85 which is adjacent to the coupling limb 53 and a front limb end section 86 which is distanced with respect to this and faces the housing front side 7. The rear connection opening 64 and expediently one of the through-holes 77 which serve for the fastening are expediently formed in the rear limb end section 85 whereas the front connection opening 65 and expediently also a second through-hole 77 which is used for fastening is located in the front limb end section 86. A limb web section 87 whose construction height which is measured in the housing height direction 5 is preferably less than that of the two limb end sections 85, 86 extends between the two limb end sections 85, 86.

The limb web section 87 in particular is arranged such that together with the two limb end sections 85, 86 it delimits a recess 88 which is open to the bottom towards the housing lower side 9. The connection limb 52 therefore considered in the housing transverse direction 4 has a U-type structure with a downwardly facing U-opening which in particular entails a minimisation of the material expense.

The first coupling part channel 62 ends in the rear limb end section 85. Only the second coupling part channel 63 passes through the limb web section 87 and extends further into the front limb end section 86.

The two axial coupling openings 66, 67 of the attachment coupling part 48 in the position of use of the attachment coupling part 48 preferably lie in the same opening plane 46 as the lateral coupling openings 44, 45. The two axial coupling openings 66, 67 in particular are formed in the coupling limb 53 next to one another in the housing transverse direction 4 and expediently lie at the same height with respect to the housing height direction 5.

Although the attachment coupling part 48 can basically be manufactured from metal, on account of the reduced manufacturing costs and the low weight a design of plastic is recommended. The different embodiments of the attachment coupling part 48 which are illustrated in the drawing are realised as plastic parts.

According to a design which is illustrated in FIGS. 1 to 5, the attachment coupling part 48 is designed as one piece. FIGS. 6 to 9 in contrast illustrate alternative multi-part construction forms of the attachment coupling part 48.

Common to the multi-part construction forms is the fact that they comprise a rear coupling part end body 91 which is assigned to the rear housing side 6 in the position of use and a front coupling part end body 92 which is separate with respect to this and is assigned to the housing front side 7.

The rear coupling part end body 91 defines the transition section 84 and has an L-shaped angled shaping with a first limb arm 91*a* and a second limb arm 91*b* which is aligned at right angles with respect to this. The first limb arm 91*a* represents the coupling limb 53, whereas the second limb arm 91*b* forms the rear limb end section 85 of the connection limb 52. Accordingly, the rear coupling part end body 91 comprises the two axial coupling openings 66, 67 as well as the rear connection opening 64. One of the optional through-holes 77 is expediently formed in the rear coupling part end body 91.

The front coupling part end body 92 comprises the front connection opening 65 and is preferably provided with a second of the optional through-holes 77 which are described above.

Figure 6:
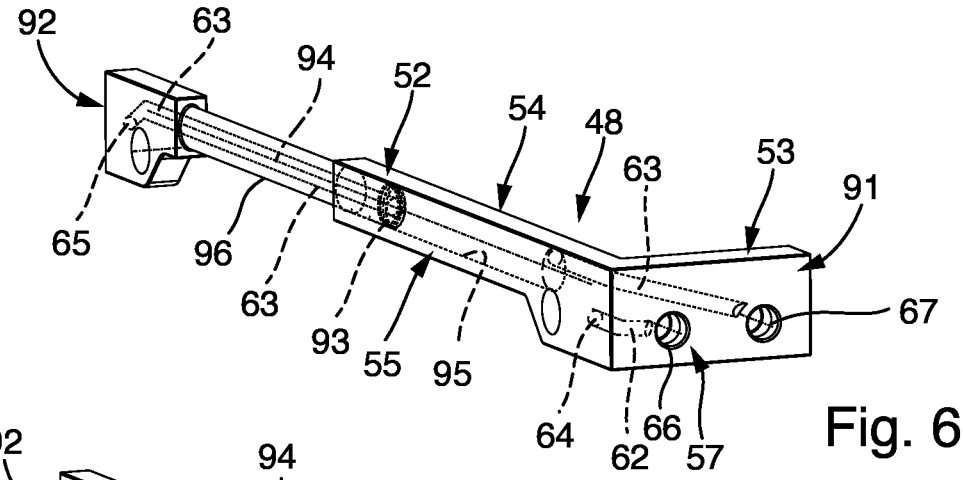
Figure 7:
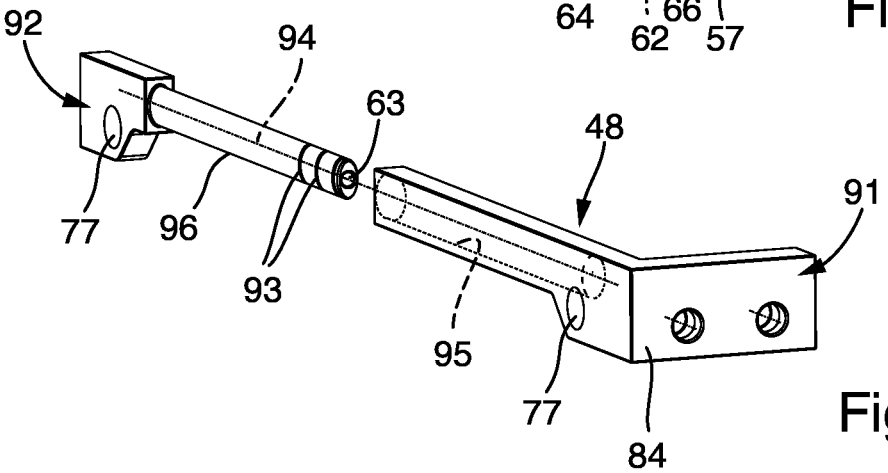
Figure 8:
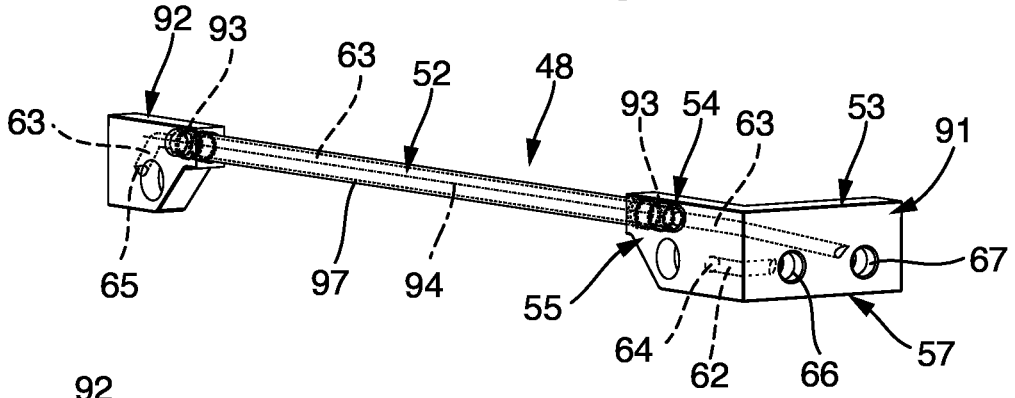
Figure 9:
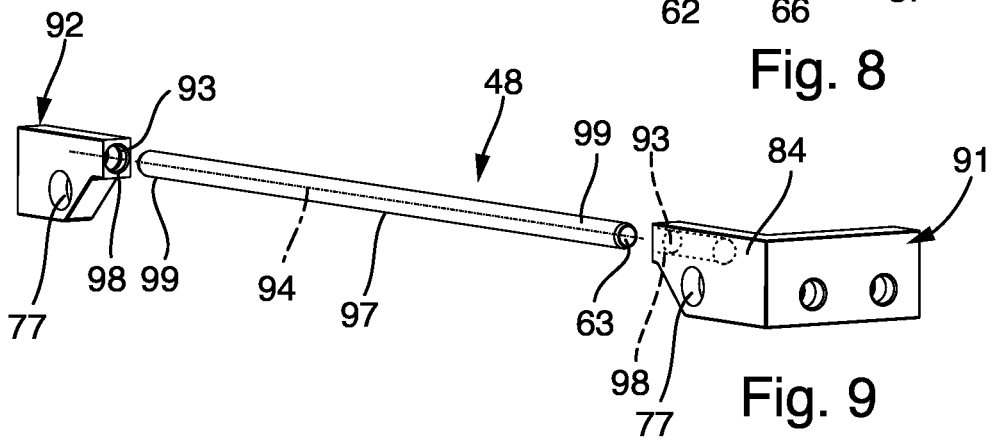

Concerning both embodiment examples of FIGS. 6 to 9, a plug-in connection is present between the rear coupling part end body 91 and the front coupling part end body 92. This with the embodiment example of FIGS. 6 and 7 is a direct plug-in connection and with the embodiment example of FIGS. 8 and 9 is an indirect plug-in connection.

The direct plug-in connection according to FIGS. 6 and 7 results from the fact that the attachment coupling part 48—disregarding an optional sealing device 93—is designed in a two-part manner and only consists of the two coupling part end bodies 91, 92 which are telescopically inserted into one another in the axis direction of a longitudinal axis 94 of the connection limb 52. The second limb arm 91*b* has a channel-like recess 95 which is open to the front coupling part end body 92 and into which the front coupling part end body 92 immerses with a rod-like continuation 96. A distance which is desired for the two connection openings 64, 65 can be set in a very simple manner by way of the two coupling part end bodies 91, 92 being inserted into one another to a corresponding extent. For the sealing, for example the rod-like continuation 96 can be provided with the already mentioned sealing device 93 which in the stuck-together state comes to lie within the channel-like recess 95.

The attachment coupling part 48 of FIGS. 6 and 7 on account of the telescoping ability of the two coupling part end bodies 91, 92 is also suitable for the use in combination with linear drives 1 having different length dimensions.

The attachment coupling part 48 according to FIGS. 8 and 9 is designed in a three-part manner disregarding an optional seal device 93. Apart from a rear and front coupling part end body 91, 92 it also comprises an additional pipe body 97 which is arranged therebetween. The two coupling part end bodies 91, 92 each have a channel-like recess 98 at the face sides which face one another in the axis direction of the longitudinal axis 94 of the connection limb 52, into which recess the pipe body 97 is inserted with one of its two end sections 99 which are opposite one another.

Concerning the embodiment of FIGS. 8 and 9, the mutual distance of the connection openings 64, 65 can be set in a very simple manner by way of a pipe body 97 which has a suitably adapted length being used.

The mentioned sealing device 93 is expediently formed by O-rings and is arranged in the channel-like recesses 98 such that it encompasses the respectively inserted end section 99 amid sealing.

Concerning both multi-part embodiment examples, the components which are stuck into one another can be contoured in a circular or non-circular manner Concerning the embodiment example of FIGS. 6 and 7, an elliptical cross-sectional contour is present. Here for example a rectangular cross-sectional contour would be conceivable. Concerning the embodiment example of FIGS. 8 and 9, the constituents which are inserted into one another are provided with a circular cross-sectional contour.

Since the two coupling part end bodies 91, 92 are fixed to the drive housing 2 independently of one another in the position of use of the attachment coupling part 48 in both illustrated embodiment examples, the design of a fixed connection between the constituents which are inserted into one another is rendered superfluous. Nevertheless, the constituents which are inserted into one another can be fixedly connected to one another, for example by way of them being pressed into one another or bonded to one another.

The type of manufacture of the attachment coupling part 48 is basically arbitrary. It is particular in the case of a multi-part construction form that injection moulding manufacture is considered. However, a manufacture by way of generative manufacturing method is considered as being particularly advantageous, and this is the case with all illustrated embodiment examples.

The manufacture by way of a 3D printing method has been found to be particularly advantageous, in particular whilst using so-called CLIP technology, wherein CLIP stands for continuous liquid interface production. Concerning this method, a fluid resin is used as a starting material, whose photo-polymerisation is controlled by way of matching UV light and oxygen. A 3D printing method which can likewise be advantageously applied is the so-called DLS technology, wherein DLS stands for digital light synthesis. Hereby, it is a further development of CLIP technology which in particular is characterised in that the chemical compounds can yet be changed by heat after the 3D printing.

Of course, other generative manufacturing methods can also be used, such as for example a laser sintering method.

With regard to the multi-part attachment coupling part 48 of FIGS. 6 to 9, the individual components can be generatively manufactured and subsequently stuck together, wherein a temperature step which is subsequent to this leads to the components which are inserted into one another being fixedly caked to one another. This type of manufacture has the advantage that one can make do without an additional sealing device 93.

What is claimed is:

1. A fluid-actuated linear drive comprising a drive housing and a drive member which by way of fluid force can be driven relative to the drive housing into a linear drive movement in a housing longitudinal direction, wherein the drive member comprises a drive unit which has a drive piston which in the drive housing divides off two drive chambers from one another, said drive chambers being successive in the housing longitudinal direction and each being connected to one of two housing channels which each with an individual lateral coupling opening run out at a housing side surface of the drive housing which is orientated transversely to the housing longitudinal direction, wherein the two housing channels can be used for the feed and discharge of a drive fluid which generates the linear drive movement of the drive member, wherein the linear drive comprises an L-shaped attachment coupling part which is separate with regard to the drive housing, has a coupling limb and a connection limb which projects transversely therefrom, and in a position of use is built onto the drive housing at the outside in a manner such that the connection limb extends in the housing longitudinal direction along the housing side surface and the coupling limb extends in a housing transverse direction which is orthogonal thereto along a housing rear surface of the drive housing which is aligned transversely to the housing side surface, wherein the attachment coupling part comprises a body, wherein a first coupling part channel and a second coupling part channel, which are separate from each other, pass through the body of the attachment coupling part without being connected to each other, said first coupling part channel having a first connection opening and a first axial coupling opening, and said second coupling part channel having a second connection opening and a second axial coupling opening, wherein said first and second connection openings each run out at an inner limb surface of the connection limb which faces the drive housing in a manner such that they are each connected to one of the two lateral coupling openings of the drive housing, and wherein said first and second axial coupling openings each run out at an outer limb surface of the coupling limb which faces away from the drive housing for allowing the feed and discharge of the drive fluid which produces the linear drive movement of the drive member, and wherein said first coupling part channel is solely defined by a channel wall surface of the body of the attachment coupling part and forms a first direct and continuous fluid connection between said first connection opening and said first axial coupling opening, and wherein said second coupling part channel is solely defined by a channel wall surface of the body of the attachment coupling part and forms a second direct and continuous fluid connection between said second connection opening and said second axial coupling opening, and said first direct and continuous fluid connection being fluidically isolated from said second direct and continuous fluid connection.

2. The linear drive according to claim 1, wherein the drive housing has a housing height direction which is orthogonal to the housing longitudinal direction and to the housing transverse direction, and the attachment coupling part comprises a transition section which is arranged between the coupling limb and the connection limb, wherein the two coupling part channels in the transition section run at a distance to one another in the housing height direction.

3. The linear drive according to claim 1, wherein each coupling part channel comprises a coupling channel section which is formed in the coupling limb and a connection channel section which is formed in the connection limb, wherein each coupling channel section is connected to a respective one of the connection channel sections via an arcuate or angled transition channel section which extends in the attachment coupling part around a rear corner region of the drive housing which lies in a transition region between the housing rear surface and the housing side surface.

4. The linear drive according to claim 1, wherein each lateral coupling opening and each axial coupling opening is provided with a fastening interface which can be used in a direct or indirect manner for coupling a fluid conduit.

5. The linear drive according to claim 4, wherein the fastening interface of each lateral coupling opening and of each axial coupling opening is an inner thread.

6. The linear drive according to claim 1, wherein the attachment coupling part in the position of use is fastened to the drive housing by way of fastening means.

7. The linear drive according to claim 6, wherein a portion of the fastening means on the attachment coupling part is assigned exclusively to the connection limb.

8. The linear drive according to claim 6, wherein the fastening means comprise two through-holes which are formed in the connection limb at a distance to one another in the housing longitudinal direction and to which a threaded bore of the fastening means which is formed in the drive housing on the housing side surface is assigned, wherein the fastening means further comprise two fastening screws which engage on the connection limb and which each pass through one of the through-holes and are screwed into one of the threaded bores, so that the connection limb is clamped to the housing side surface.

9. The linear drive according to claim 6, wherein the attachment coupling part in the position of use is fastened to the drive housing by way of the fastening means in a releasable manner.

10. The linear drive according to claim 1, wherein a sealing ring which frames a respective one of the connection openings is arranged between the housing side surface and the inner limb surface of the connection limb in a region of each lateral coupling opening.

11. The linear drive according to claim 1, wherein the connection limb of the attachment coupling part comprises two limb end sections which are opposite one another in the housing longitudinal direction and in which respectively one of the two connection openings is formed and between which a limb web section extends, a height of which limb web section measured in a housing height direction which is orthogonal to the housing longitudinal direction and to the housing transverse direction is lower than a height of the two limb end sections.

12. The linear drive according to claim 1, wherein the two axial coupling openings of the coupling limb are arranged next to one another in the housing transverse direction.

13. The linear drive according to claim 12, wherein the two axial coupling openings of the coupling limb are arranged at a same height in a housing height direction which is orthogonal to the housing longitudinal direction and the housing transverse direction.

14. The linear drive according to claim 1, wherein the attachment coupling part is designed as one piece.

15. The linear drive according to claim 1, wherein the attachment coupling part is designed in a multi-part manner, wherein it comprises an angled rear coupling part end body which comprises the two axial coupling openings and a rear connection opening of the two connection openings, as well as a front coupling part end body which comprises a front connection opening of the two connection openings, said end bodies being inserted into one another in telescopic manner in the region of the connection limb.

16. The linear drive according to claim 1, wherein the attachment coupling part is designed in a multi-part manner, wherein it has an angled rear coupling part end body which comprises the two axial coupling openings and a rear connection opening of the two connection openings, a front coupling part end body which comprises a front connection opening of the two connection openings, and a pipe body which is arranged therebetween, wherein the pipe body with end sections which are opposite one another is inserted into the two coupling part end bodies.

17. The linear drive according to claim 1, wherein the attachment coupling part consists of one or more components which are generatively manufactured by way of 3D printing.

18. The linear drive according to one claim 1, wherein the drive unit is a first drive unit of the drive member which comprises the drive piston, wherein the drive member further comprises a second drive unit which is arranged next to the first drive unit and which comprises a drive piston which in the drive housing likewise divides off two drive chambers from one another, said drive chambers being successive in the housing longitudinal direction, wherein the drive chambers which are divided off from one another by the drive piston of the second drive unit, via an individual transverse channel are each constantly fluidically connected within the drive housing to one of the two drive chambers which are separated from one another by the drive piston of the first drive unit.

19. The linear drive according to claim 1, wherein the drive member comprises a slide body which is linearly displaceably mounted on the drive housing at an outside of the drive housing by way of a linear guide device of the linear drive and on which at least one fastening interface is formed.

* * * * *